United States Patent [19]

Thomas

[11] Patent Number: 4,841,678

[45] Date of Patent: Jun. 27, 1989

[54] TOOL SHARPENING APPARATUS

[76] Inventor: Peter C. Thomas, 6750 Riverside Blvd., Sacramento, Calif. 95831

[21] Appl. No.: 145,150

[22] Filed: Jan. 19, 1988

[51] Int. Cl.[4] ..... B24B 41/00

[52] U.S. Cl. ..... 51/219 R; 51/217 A; 51/218 A; 51/219 PC; 51/98.5

[58] Field of Search ..... 51/217 A, 219 R, 218 A, 51/218 T, 219 PC, 216 A, 216 T, 216 R, 98.5, 217 R, 217 T

[56] References Cited

U.S. PATENT DOCUMENTS 3,680,268 8/1972 Lorton ..... 51/218 A
4,646,474 3/1987 Chen ..... 51/219 R X

FOREIGN PATENT DOCUMENTS 841112 4/1952 Fed. Rep. of Germany ..... 51/50 R

*Primary Examiner*—Frederick R. Schmidt

*Assistant Examiner*—Maurina Rachuba

*Attorney, Agent, or Firm*—Leon Gilden

[57] ABSTRACT

A tool sharpening apparatus is set forth particularly for use in combination with grinding wheels wherein multi-adjustment and angularly displaceable supports cooperate to present a desired complex presentation of tool faces to be sharpened. Particularly a base supports a first protractor support by an associated tongue and groove arrangement wherein a second pivotal support is angularly displaceable relative to said first protractor support. A third laterally adjustable support cooperates by a further tongue and groove arrangement with said second pivotal support to secure adjustably a fourth depth adjustment support to orient a tool face relative to a grinding wheel. A fifth protractor support is secured to said fourth depth adjustment support wherein a sixth tool holder support is angularly adjustable relative to said fifth protractor support. Accordingly, any desired grinding of a secured tool may be effected.

10 Claims, 7 Drawing Sheets

TOOL SHARPENING APPARATUS

BACKGROUND OF THE INVENTION

1. Field of the Invention

The present arrangement relates to tool support apparatus and more particularly pertains to a new and improved tool sharpening apparatus for cooperation with a grinding wheel which may adjustable in any of a variety of complex motions to surface grind a wide range of tool faces.

2. Description of the Prior Art

The use of securement apparatus for the sharpening of various instruments is well known in the prior art. As may be appreciated, these devices have been of a variety of organizations to enable sharpening of a wide range of instruments for sharpening and the like. Apparatus of the prior art has, in one form or another, failed to accommodate the varying range of instrument presentations to a grinding tool required in the sharpening and surface grinding of various tools and the like. While various prior art apparatus has attempted to resolve the problem of providing a plurality of motions to accommodate a plurality of grinding needs, they have typically been of unnecessarily complex and expansive structure in effecting this desired result. For example, U.S. Pat. No. 3,859,762 to Ludwig provides a reciprocating carriage and transverse positioners thereof to present a forward edge of a blade between a pair of grinding wheels for imparting a grinding utilizing convexly shaped grinding surfaces to present a larger number of cutting operations prior to the loss of effectiveness. The elaborate and complex structure of the Ludwig patent not only fails to provide the variable adjusting parameters of the instant invention but is limited to the type of tools that may be positioned between the noted grinding wheels.

U.S. Pat. No. 4,555,965 to Deaton presents a scissor corrugating device wherein an upper guide attached to a file at upper end and a lower guide attached to the file at lower end is secured within a frame with a vice for securing the scissors and presenting the blade of the scissors at various angles to the file. The structure and organization of the Deaton patent is of a greatly limited utility as compared to the instant invention that enables multiple lateral and forward adjustments of a cutting tool relative to a grinding wheel as well as angular displacement of the cutting tool, as desired.

U.S. Pat. No. 3,011,366 to Sandven provides a blade sharpening jig wherein a clamping mechanism secures a blade to an underlying support whereby a file may be drawn supported by upwardly oriented rollers relative to the blade to grind an edge on the associated blade.

U.S. Pat. No. 2,971,408 to Robins sets forth a knife serrating apparatus where a clamping jig secures a knife relative to a rotating cutting blade to serrate an associate knife with means to enable repositioning of the knife to enable corrugating thereof therealong the blade.

U.S. Pat. No. 3,583,261 to Sheppard utilizes a tool indexing device of complex and multiple supports wherein a tool is advanced longitudinally with respect to a contact position to sharpen said blade wherein a plurality of "V" shaped grooves with an associated indexing block to enable sequential movement of the tool to be sharpened. As in other prior art references, the Sheppard patent is a relatively complex organization relative the instant invention and further does not provide the flexibility of the instant invention in accommodating a variety of blades and imparting any desired grinding contour to said blade.

As such, it may be appreciated that there is a continuing need for a new and improved tool sharpening apparatus which addresses both the problem of compactness and adjustability, and in this respect, the present invention substantially fulfills this need.

SUMMARY OF THE INVENTION

In view of the foregoing disadvantages inherent in the known types of tool sharpening securement devices now present in the prior art, the present invention provides an tool sharpening device which provides multiple adjustability of an associated blade presented to a grinding wheel and is of a compact and precise organization to enable repetition of sharpening orientations of a blade to a grinding wheel. As such, the general purpose of the present invention, which will be described subsequently in greater detail, is to provide a new and improved tool sharpening apparatus which has all the advantages of the prior art tool sharpening devices and none of the disadvantages.

To attain this, the present invention comprises a multi-part apparatus wherein each part is adjustable relative to the other to present an infinite potential of orientations of a tool to be sharpened relative to a grind wheel. A base adjustably secures a protractor support slidably thereon and a second support is pivotally secured to said first support. A third adjustable support is laterally positionable relative to said second support with a fourth depth adjustment support positionable forwardly relative to a grinding wheel. A fifth support is securable to said fourth support with a sixth tool holder support angularly adjustable relative to said fifth support.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool sharpening apparatus which has all the advantages of the prior art tool sharpening apparatus and none of the disadvantages.

It is another object of the present invention to provide a new and improved tool sharpening apparatus which may be easily and efficiently manufactured and marketed.

It is a further object of the present invention to provide a new and improved tool sharpening apparatus which is of a durable and reliable construction.

An even further object of the present invention is to provide a new and improved tool sharpening apparatus which is susceptible of a low cost of manufacture with regard to both materials and labor, and which accordingly is then susceptible of low prices of sale to the consuming public, thereby making such tool sharpening apparatus economically available to the buying public.

Still yet another object of the present invention is to provide a new and improved tool sharpening apparatus which provides in the apparatuses and methods of the prior art some of the advantages thereof, while simultaneously overcoming some of the disadvantages normally associated therewith.

Still another object of the present invention is to provide a new and improved tool sharpening apparatus wherein a tool may be presented relative to a grinding wheel in a multiple variety of orientations relative thereto.

Yet another object of the present invention is to provide a new and improved tool sharpening apparatus wherein a multi-part inter-related apparatus presents an infinite variety of adjustments by enabling positioning of the various parts relative to one another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
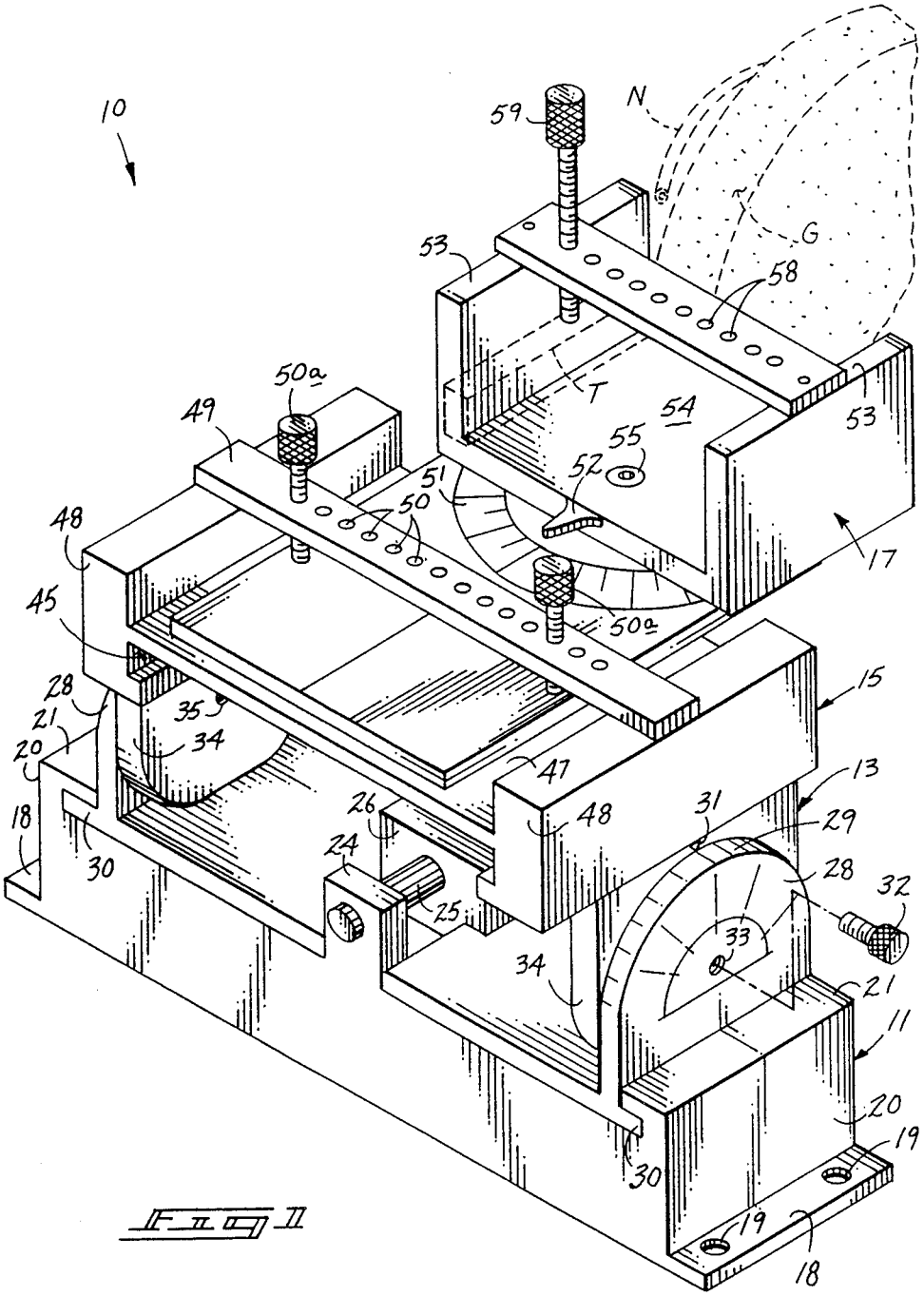
FIG. 1 is an isometric illustration of the instant invention illustrating the various parts, their configuration, and relationship.
Figure 2:
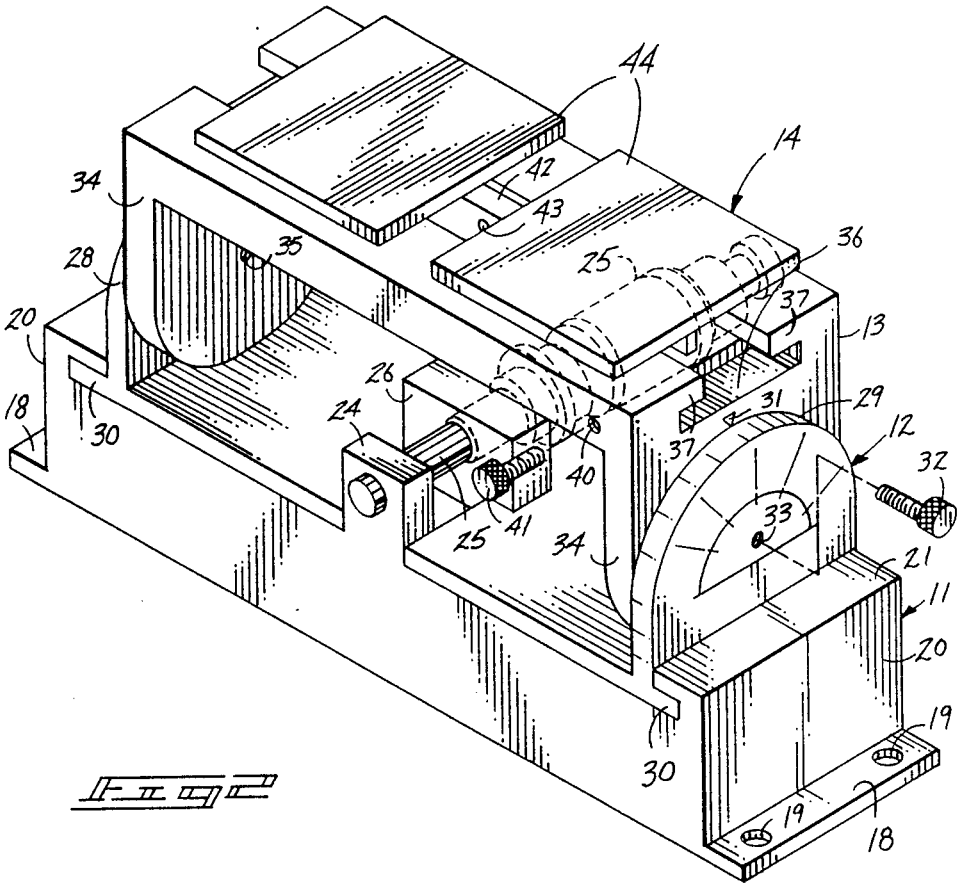
FIG. 2 is an isometric illustration of the base, first protractor part, second pivotal support, and third lateral adjustment support.
Figure 3:
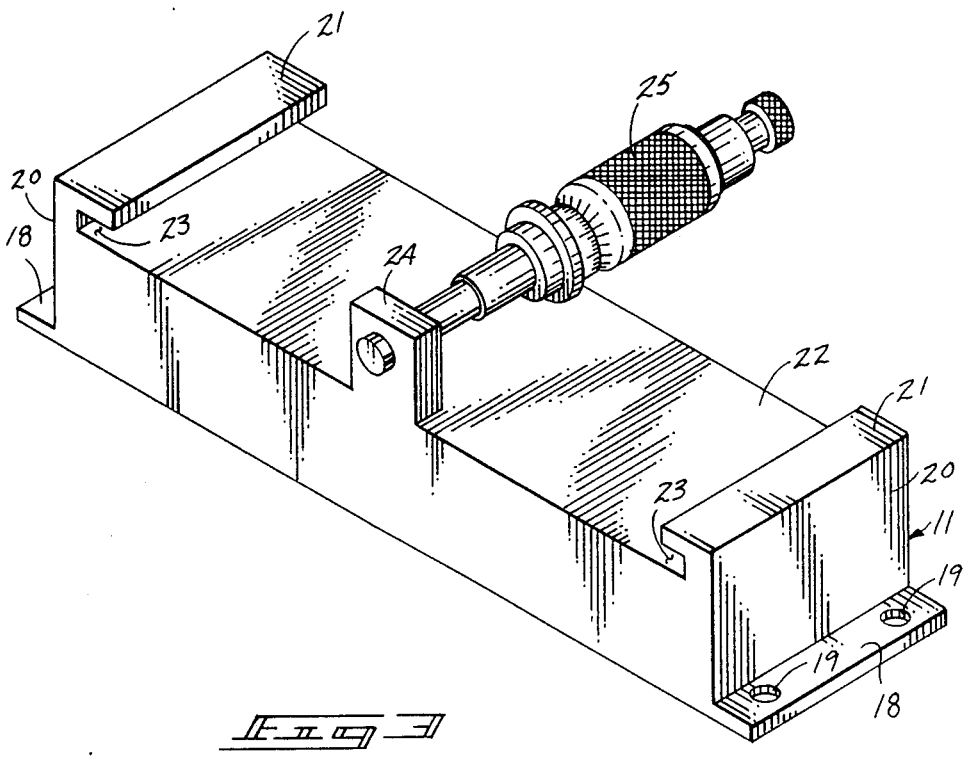
FIG. 3 is an isometric illustration of the base of the instant invention illustrating the micrometer adjustment of the base to adjust the first protractor support.
Figure 4:
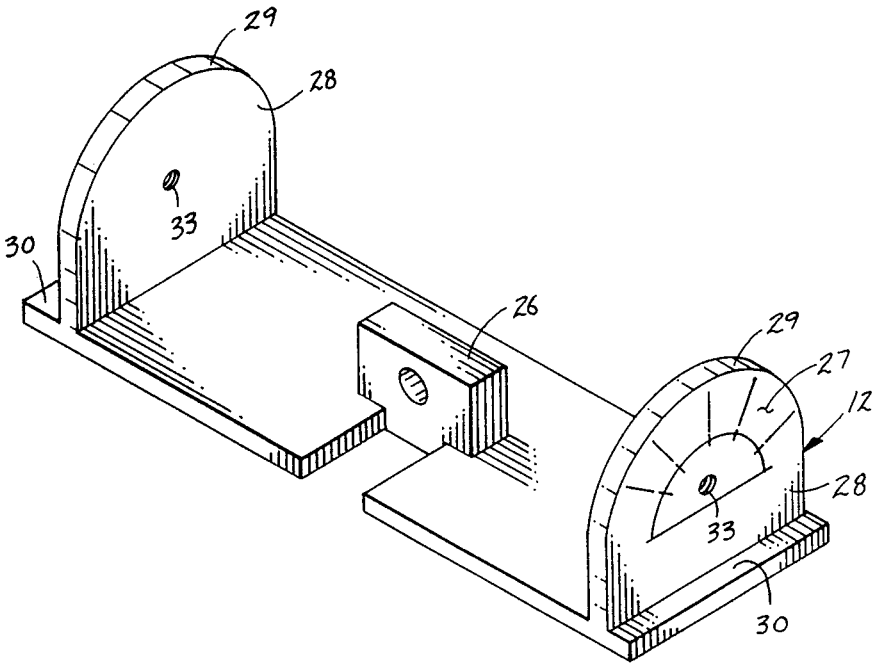
FIG. 4 is an isometric illustration of the first protractor support.
Figure 5:
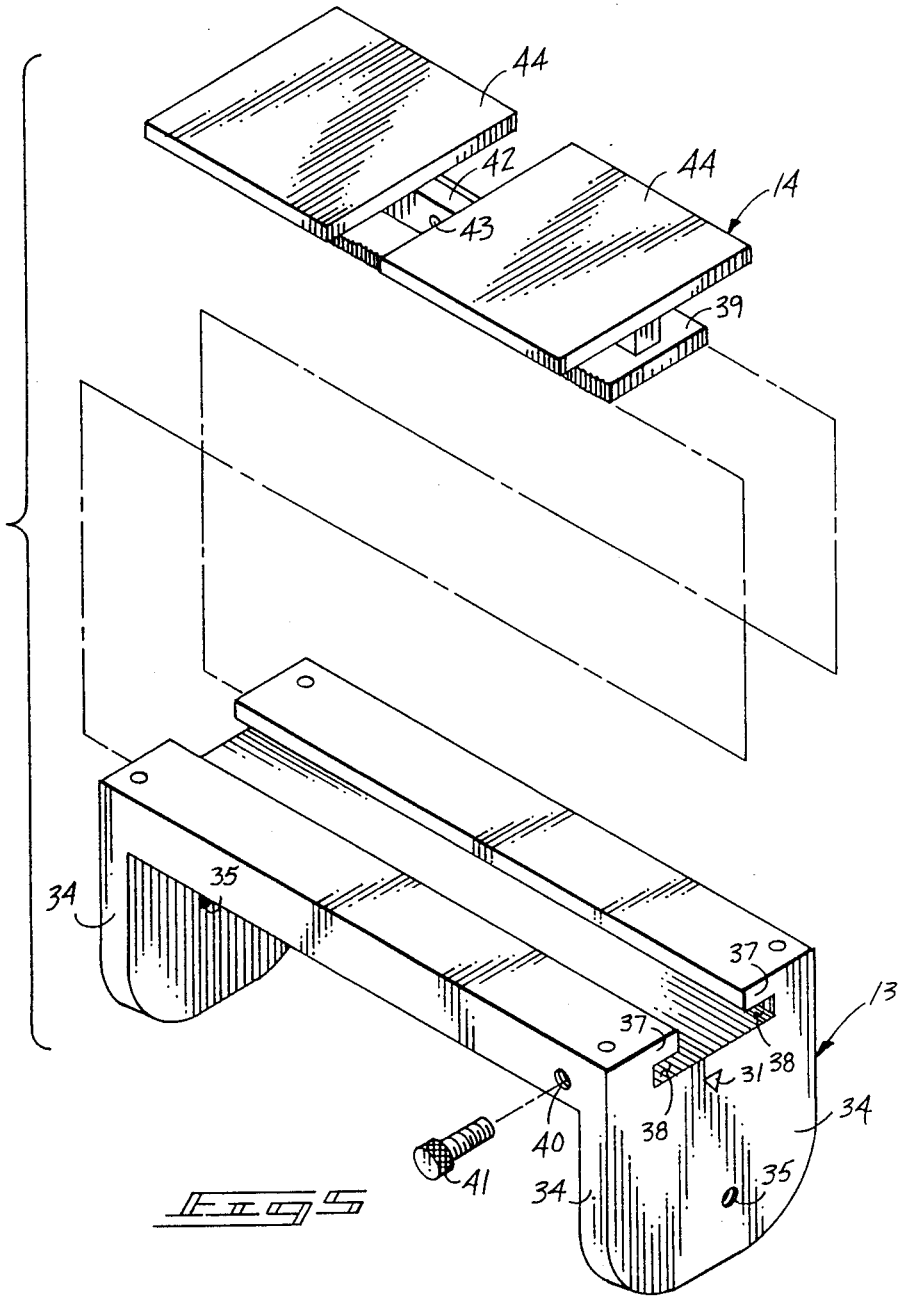
FIG. 5 is an isometric illustration of the second pivotal support and the third adjustable support in an exploded position relative to one another.
Figure 6:
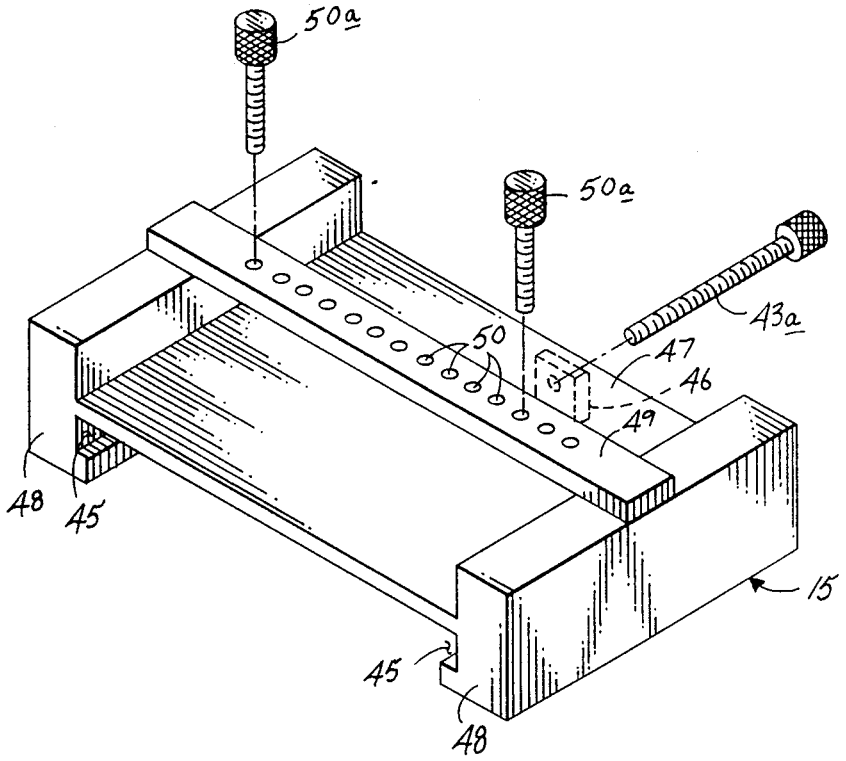
FIG. 6 is an isometric illustration of the fourth depth adjustment support.
Figure 7:
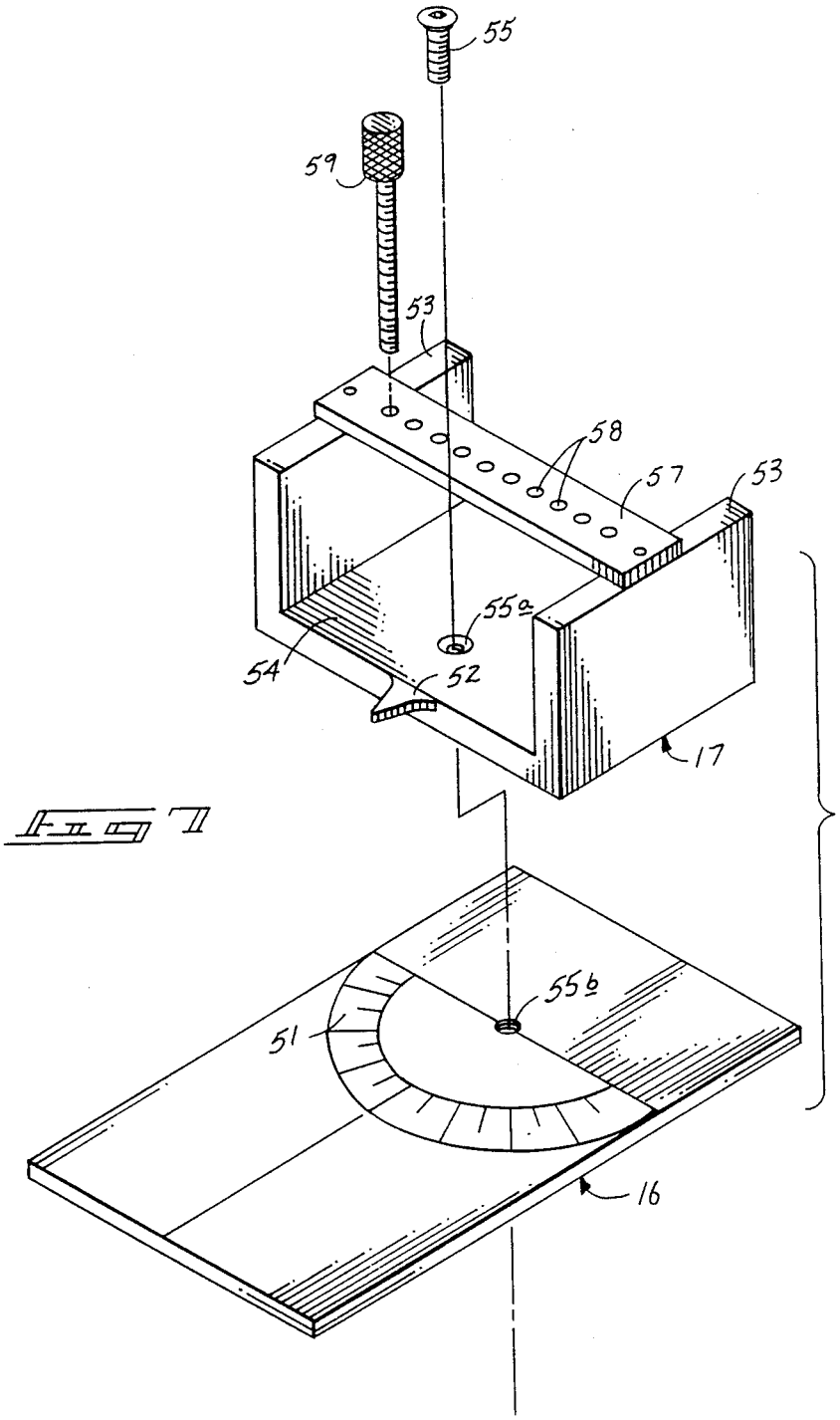
FIG. 7 is an isometric illustration of the fifth protractor support and the sixth tool holder support in expanded orientation relative to one another.

With reference now to the drawings, and in particular to FIGS. 1 to 7 thereof, a new and improved tool sharpening apparatus embodying the principles and concepts of the present invention and generally designated by the reference numeral 10 will be described.

More specifically, it will be noted that the tool sharpening apparatus 10 essentially comprises a base 11 slidably receiving a first protractor support 12 that in turn pivotally receives a second pivotal support 13. The second pivotal support 13 slidably receives a third laterally adjustable support 14 that secures in an adjustable relationship the fourth depth adjustment support 15. The fourth depth adjustment support 15 secures thereto a fifth protractor support 16 that in turn secures a sixth tool holder support 17 pivotally thereto.

Support base 11 includes a pair of securement flanges 18 formed with openings 19 therethrough to enable securement of the apparatus 10 to a desired surface. End surfaces 20 depend upwardly from securement flanges 18 and terminate in overlying flanges 21 defining a plurality of grooves 23 between the overlying flanges 21 and upper surface 22 of the base 11. Integrally secured at a rear forward side of base 11 is an upstanding boss 24 fixedly receiving micrometer 25 rotatably secured within a second depending boss 26 integrally secured to the first protractor support 12. This configuration enables the precise adjustment of first protractor support 12 relative to base 11 by the manual manipulation of micrometer 25 to enable forward and rearward positioning of the aforenoted first protractor support 12 as it is guidingly secured within the grooves 23 by the complementarily shaped tongues 30 slidable therein. A protractor scale 27 is imposed on each end wall 28 of first protractor support 12 wherein each end wall terminates in a curvilinear upper surface 29 to cooperate with an indicator 31 for visual indication of the degree of angularity of second pivotal support 13 relative to first protractor support 12. A plurality of threaded fasteners 32 are positionable through bores 33 formed in end walls 28 and engage threaded bores 35 formed within outwardly depending walls 34 of second pivotal support 13.

A bridge floor 36 joins the two downwardly depending walls 34 of second pivotal support 13 wherein a plurality of second overlying flanges 37 form a plurality of second grooves 38 with bridge floor 36 to slidingly capture platen 39 therein which may in turn be secured as desired within grooves 38 by securement fastener 41 orthogonally oriented to platen 39 and imposing on platen 39 through threaded bore 40 to frictionally engage and secure the platen as desired.

Platen 39 is integrally formed to riser 42 with a threaded bore formed medially therethrough between the plurality of capture plates 44. The capture plates 44 cooperate with third groove 45 formed within fourth depth adjustment support 15 by the "L" shaped side walls 48 integrally joined by intermediate linking plate 47. A downwardly depending boss 46 rotatably and positionally secures a fine adjustment screw 43*a* therein to cooperate with threaded bore 43 of riser 42 to effect forward and rearward adjustment of the fourth depth adjustment support 15.

A bridge link 49 integrally secured and spanning the "L" shaped side walls 48 has formed therein a plurality of threaded bores 50 to cooperate with a complementarily threaded plurality of lock fasteners 50*a* to secure the fifth protractor support 16 onto linking plate 47.

A protractor 51 is imposed on a forward end of the fifth protractor support 16 whereby an indicator 52 integrally formed to the "U" shaped sixth tool holder support 17 may visually indicate angularity of support 17 relative to support 16.

The sixth tool holder support 17 is formed with a plurality of upstanding walls 53 secured integrally to floor 54 wherein a fastener 55 cooperate through bores 55*a* and 55*b* enables pivotal oscillation of the sixth tool holder support 17 relative to the fifth protractor support 16 whereby bore 55*b* is threaded in a complementary fashion to fastener 55 to enable interlocking of the support 17 and support 16 until desired angularity is achieved.

An overlying link 57 joining a plurality of walls 53 together is formed with a plurality of threaded bores 58 cooperating with fasteners 59 to secure a tool "T" between said fastener and the floor 54, as illustrated in FIG. 1, to cooperate with the grinding wheel "G" which may be formed with a coolant nozzle "N" to grip a cooling medium onto the tool as it is being surface ground to shape.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tool sharpening apparatus for the clamping and selective orientation of a tool to cooperate with a shaping tool wherein said apparatus comprises a base means for slidingly accepting a first support means in a first direction, and said first support means including a measurement scale cooperating with an indicator on a second support means formed exteriorly on one of a plurality of spaced upwardly extending flanges integrally formed to said first support means, and said second support means including a plurality of spaced downwardly extending flanges contiguously positioned interiorly of said upwardly extending flanges and pivotally mounted to said upwardly extending flanges of said first support means about an axis extending orthogonally through said upper and lower flanges;

a third support means slidingly positionable within said second support means in a second direction orthogonal to the first direction;

a fourth support means slidingly cooperating with said third support means in a third direction;

a fifth support means selectively securable to the fourth support means, and a sixth support means angularly adjustable to the fifth support means wherein said fifth support means includes clamping means for securement of said tool.

2. A tool sharpening apparatus as set forth in claim 1 wherein said third direction is orthogonal to said second direction.

3. A tool sharpening apparatus as set forth in claim 2 wherein said base means and said first support means slidingly cooperate by a tongue and groove arrangement.

4. A tool sharpening apparatus as set forth in claim 3 wherein said third and fourth support means slidingly cooperate in a tongue and groove arrangement.

5. A tool sharpening apparatus as set forth in claim 4 wherein said second and third support means are slidingly positionable by a tongue and groove arrangement.

6. A tool sharpening apparatus as set forth in claim 5 wherein said measurement scale is a protractor scale.

7. A tool sharpening apparatus as set forth in claim 6 wherein a protractor scale is positioned on said fifth support means to cooperate with an indicator formed on said sixth support means and said sixth support means is clampingly and pivotally securable to said fifth support means.

8. A tool sharpening apparatus as set forth in claim 7 wherein said fourth support means includes a plurality of clamping elements for clampingly securing said fifth support means to said fourth support means.

9. A tool sharpening apparatus as set forth in claim 8 wherein said first support means is slidingly adjustable relative to said base means by a micrometer means secured to an upstanding boss medially of said base means and to a boss secured to said first support means for precise relative positioning of said first support means relative to said base means.

10. A tool sharpening apparatus as set forth in claim 9 wherein said fourth support means includes a downwardly depending boss with a fine adjustment screw securable therethrough to cooperate with said third support means for slidingly securing said fourth support means relative to said third support means.

* * * * *